US011852091B1

(12) United States Patent
Gwidt et al.

(10) Patent No.: US 11,852,091 B1
(45) Date of Patent: Dec. 26, 2023

(54) IDLE MODE FOR ENGINES WITH PORT FUELD INJECTION (PFI) AND DIRECT INJECTION (DI) FUEL SYSTEMS

(71) Applicant: GM GLOBAL TECHNOLOGY OPERATIONS LLC, Detroit, MI (US)

(72) Inventors: J. Michael Gwidt, Brighton, MI (US); Matthew D. Defever, Berkley, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/822,007

(22) Filed: Aug. 24, 2022

(51) Int. Cl.

| | |
|---|---|
| ***F02D 41/16*** | (2006.01) |
| ***F02D 41/38*** | (2006.01) |
| ***F02D 41/14*** | (2006.01) |
| ***F02D 41/32*** | (2006.01) |

(52) U.S. Cl.
CPC ..... *F02D 41/16* (2013.01); *F02D 41/1498* (2013.01); *F02D 41/32* (2013.01); *F02D 41/38* (2013.01); *F02D 2041/389* (2013.01); *F02D 2200/1012* (2013.01); *F02D 2200/501* (2013.01)

(58) Field of Classification Search
CPC ..... F02D 41/1498; F02D 41/16; F02D 41/32–365; F02D 41/38; F02D 2041/389; F02D 2200/1012; F02D 2200/501
See application file for complete search history.

(56) References Cited

U.S. PATENT DOCUMENTS

| | | | | |
|---|---|---|---|---|
| 7,500,469 | B2 * | 3/2009 | Akita | B60L 15/20 701/110 |
| 9,180,871 | B2 * | 11/2015 | Ando | B60K 6/445 |
| 2016/0258345 | A1 * | 9/2016 | Kimura | F02D 35/023 |

FOREIGN PATENT DOCUMENTS

JP 2014062526 A * 4/2014

* cited by examiner

*Primary Examiner* — Hung Q Nguyen
*Assistant Examiner* — Mark L. Greene
(74) *Attorney, Agent, or Firm* — Lorenz & Kopf LLP

(57) ABSTRACT

In accordance with an exemplary embodiment, a method is provided for controlling operation of an engine of a vehicle during an idle mode of operation for the engine, the engine having a plurality of different types of fuel injectors and a combustion chamber, including: obtaining, via one or more first sensors of the vehicle, first sensor data as to a speed of the vehicle; obtaining, via one or more second sensors of the vehicle, second sensor data as to a measure of roughness of the engine; and adjusting, via instructions provided by a processor of the vehicle, a fuel injection ratio of respective amounts of fuel provided by the plurality of different types of fuel injectors to the combustion chamber, based on both the speed of the vehicle and the measure of roughness of the engine.

20 Claims, 2 Drawing Sheets

IDLE MODE FOR ENGINES WITH PORT FUELD INJECTION (PFI) AND DIRECT INJECTION (DI) FUEL SYSTEMS

INTRODUCTION

The technical field generally relates to the field of vehicles and, more specifically, to control of engines having both port fuel injection (PFI) and direct injection (DI) fuel systems.

Many vehicles today have drive systems that include engines, such as internal combustion engines, that can operate under an idle engine mode at times. However, such engine may not always provide optimal engine operation under certain conditions.

Accordingly, it is desirable to provide systems and methods for controlling engines, including an idle mode therefor. Furthermore, other desirable features and characteristics of the present invention will become apparent from the subsequent detailed description of the invention and the appended claims, taken in conjunction with the accompanying drawings and this background of the invention.

SUMMARY

In accordance with an exemplary embodiment, a method is provided for controlling operation of an engine of a vehicle during an idle mode of operation for the engine, the engine having a plurality of different types of fuel injectors and a combustion chamber, the method including: obtaining, via one or more first sensors of the vehicle, first sensor data as to a speed of the vehicle; obtaining, via one or more second sensors of the vehicle, second sensor data as to a measure of roughness of the engine; and adjusting, via instructions provided by a processor of the vehicle, a fuel injection ratio of respective amounts of fuel provided by the plurality of different types of fuel injectors to the combustion chamber, based on both the speed of the vehicle and the measure of roughness of the engine.

Also in an exemplary embodiment, the plurality of different types of fuel injectors includes a port fuel injector and a direct fuel injector; and the adjusting of the fuel injection ratio includes adjusting the fuel injection ratio of the respective amounts of fuel provided by the port fuel injector and the direct fuel injector, respectively, based on both the speed of the vehicle and the measure of roughness of the engine.

Also in an exemplary embodiment, the adjusting of the fuel injection ratio includes increasing a ratio of (a) fuel provided by the port fuel injector to the combustion chamber to (b) a total fuel provided by the port fuel injector and the direct fuel injector combined to the combustion chamber (the "PDI Ratio") from an initial value to an increased value, when the speed of the vehicle is less than a predetermined threshold.

Also in an exemplary embodiment, the adjusting of the fuel injection ratio further includes reducing the PDI ratio from its increased value to its initial value, when the speed of the vehicle is no longer less than the predetermined threshold.

Also in an exemplary embodiment, the increasing of the PDI Ratio includes increasing the PDI ratio to a maximum PDI ratio, subject to the measure of roughness of the engine.

Also in an exemplary embodiment, the adjusting of the fuel injection ratio further includes reducing the PDI ratio, when the measure of roughness of the engine exceeds a second predetermined threshold.

Also in an exemplary embodiment, the adjusting of the fuel injection ratio further includes increasing the PDI ratio, when the measure of roughness of the engine is less than or equal to the second predetermined threshold.

Also in an exemplary embodiment: the obtaining the second sensor data includes obtaining engine data as to a change in engine speed of the engine over time; and the adjusting of the fuel injection ratio includes adjusting the PDI ratio, via the instructions provided by the processor, by: reducing the PDI ratio, when the change in engine speed over time exceeds a second predetermined threshold; and increasing the PDI ratio, when the change in engine speed over time does not exceed the second predetermined threshold.

In another exemplary embodiment, a system is provided for controlling operation of an engine of a vehicle during an idle mode of operation for the engine, the engine having a plurality of different types of fuel injectors and a combustion chamber, the system including: one or more first sensors of the vehicle that are configured to obtain first sensor data as to a speed of the vehicle; one or more second sensors of the vehicle that are configured to obtain second sensor data as to a measure of roughness of the engine; and a processor that is coupled to both the one or more first sensors and the one or more second sensors and that is configured to at least facilitate adjusting a fuel injection ratio of respective amounts of fuel provided by the plurality of different types of fuel injectors to the combustion chamber, based on both the speed of the vehicle and the measure of roughness of the engine, via instructions provided by the processor.

In another exemplary embodiment, the plurality of different types of fuel injectors includes a port fuel injector and a direct fuel injector; and the processor is configured to at least facilitate increasing a ratio of (a) fuel provided by the port fuel injector to the combustion chamber to (b) a total fuel provided by the port fuel injector and the direct fuel injector combined to the combustion chamber (the "PDI Ratio") from an initial value to an increased value, when the speed of the vehicle is less than a predetermined threshold.

Also in an exemplary embodiment, the processor is configured to at least facilitate: increasing the PDI ratio to a maximum PDI ratio, subject to the measure of roughness of the engine; and adjusting the fuel injection ratio by reducing the PDI ratio from its increased value to its initial value, when the speed of the vehicle is no longer less than the predetermined threshold.

Also in an exemplary embodiment, the processor is configured to at least facilitate: reducing the PDI ratio, when the measure of roughness of the engine exceeds a second predetermined threshold; and increasing the PDI ratio, when the measure of roughness of the engine is less than or equal to the second predetermined threshold.

Also in an exemplary embodiment: the one or more first sensors and configured to obtain obtaining engine data as to a change in engine speed of the engine over time; and the processor is configured to at least facilitate adjusting the PDI ratio, via the instructions provided by the processor, by: reducing the PDI ratio, when the change in engine speed over time exceeds a second predetermined threshold; and increasing the PDI ratio, when the change in engine speed over time does not exceed the second predetermined threshold.

In another exemplary embodiment, a vehicle is provide that includes: an engine having a plurality of different types of fuel injectors and a combustion chamber; one or more first sensors of the vehicle that are configured to obtain first sensor data as to a speed of the vehicle; one or more second sensors of the vehicle that are configured to obtain second sensor data as to a measure of roughness of the engine; and a processor that is coupled to both the one or more first sensors and the one or more second sensors and that is configured to at least facilitate adjusting a fuel injection ratio of respective amounts of fuel provided by the plurality of different types of fuel injectors to the combustion chamber, based on both the speed of the vehicle and the measure of roughness of the engine, via instructions provided by the processor.

Also in an exemplary embodiment: the plurality of different types of fuel injectors includes a port fuel injector and a direct fuel injector; and the processor is configured to at least facilitate adjusting the fuel injection ratio of the respective amounts of fuel provided by the port fuel injector and the direct fuel injector, respectively, based on both the speed of the vehicle and the measure of roughness of the engine.

Also in an exemplary embodiment, the processor is configured to at least facilitate increasing a ratio of (a) fuel provided by the port fuel injector to the combustion chamber to (b) a total fuel provided by the port fuel injector and the direct fuel injector combined to the combustion chamber (the "PDI Ratio") from an initial value to an increased value, when the speed of the vehicle is less than a predetermined threshold.

Also in an exemplary embodiment, the processor is configured to at least facilitate adjusting the fuel injection ratio by reducing the PDI ratio from its increased value to its initial value, when the speed of the vehicle is no longer less than the predetermined threshold.

Also in an exemplary embodiment, the processor is configured to at least facilitate increasing the PDI ratio to a maximum PDI ratio, subject to the measure of roughness of the engine.

Also in an exemplary embodiment, the processor is configured to at least facilitate: reducing the PDI ratio, when the measure of roughness of the engine exceeds a second predetermined threshold; and increasing the PDI ratio, when the measure of roughness of the engine is less than or equal to the second predetermined threshold.

Also in an exemplary embodiment, the one or more first sensors and configured to obtain obtaining engine data as to a change in engine speed of the engine over time; and the processor is configured to at least facilitate adjusting the PDI ratio, via the instructions provided by the processor, by: reducing the PDI ratio, when the change in engine speed over time exceeds a second predetermined threshold; and increasing the PDI ratio, when the change in engine speed over time does not exceed the second predetermined threshold.

DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the disclosure or the application and uses thereof. Furthermore, there is no intention to be bound by any theory presented in the preceding background or the following detailed description.

Figure 1:
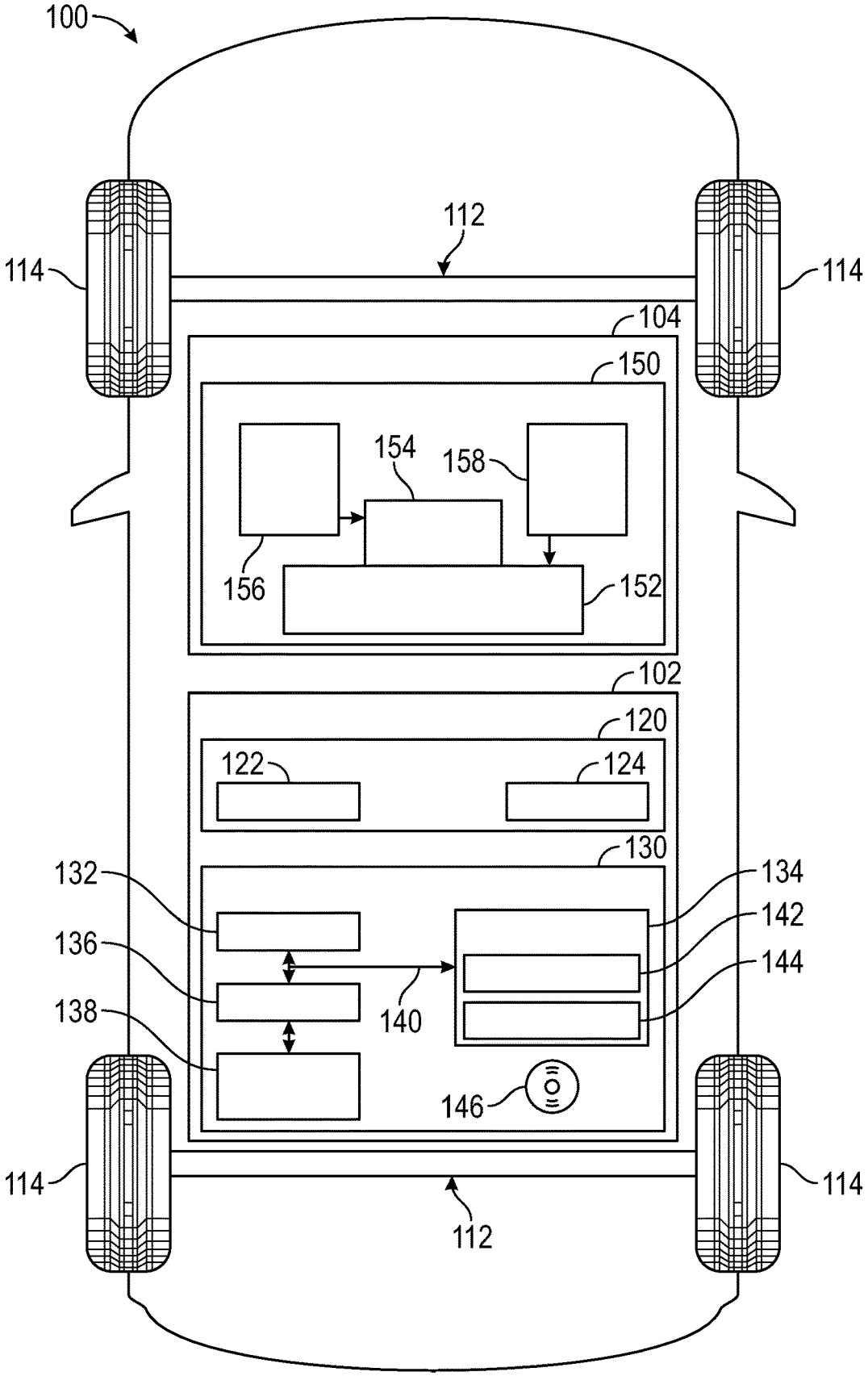
FIG. 1 is a functional block diagram of a vehicle that includes a drive system having an engine with a port fuel injector and a direct fuel injector, and a control system that is used for controlling the engine, including an idle mode for the engine, using control of the port fuel injector and the direct fuel injector based on vehicle speed and engine roughness, in accordance with an exemplary embodiment.

FIG. 1 illustrates a vehicle 100, according to an exemplary embodiment. As described in greater detail further below, the vehicle 100 includes a drive system 104 with an engine 150 having a port fuel injector 156 and a direct fuel injector 158. Also as described in greater detail further below and depicted in FIG. 1, the vehicle 100 also includes a control system 102. As described in greater detail further below in connection with the vehicle 100 of FIG. 2 as well as the process 200, in various embodiments the control system 102 controls the engine 150, including an idle mode for the engine 150, using control of the port fuel injector 156 and the direct fuel injector 158 based on a speed of the vehicle 100 and a measure of roughness for the engine 150.

In certain embodiments, the vehicle 100 comprises an automobile. In various embodiments, the vehicle 100 may be any one of a number of different types of automobiles, such as, for example, a sedan, a wagon, a truck, or a sport utility vehicle (SUV), and may be two-wheel drive (2WD) (i.e., rear-wheel drive or front-wheel drive), four-wheel drive (4WD) or all-wheel drive (AWD), and/or various other types of vehicles in certain embodiments. In certain embodiments, the vehicle 100 may also comprise a motorcycle and/or one or more other types of vehicles. In addition, in various embodiments, it will also be appreciated that the vehicle 100 may comprise any number of other types of mobile platforms.

In the depicted embodiment, the vehicle 100 includes a body 110 that substantially encloses other components of the vehicle 100. Also in the depicted embodiment, the vehicle 100 includes a plurality of axles 112 and wheels 114. The wheels 114 are each rotationally coupled to one or more of the axles 112 near a respective corner of the body 110 to facilitate movement of the vehicle 100. In one embodiment, the vehicle 100 includes four wheels 114, although this may vary in other embodiments (for example for trucks and certain other vehicles).

The drive system 104 drives the wheels 114. In the depicted embodiment, the drive system 104 comprises a propulsion system, and includes the above-referenced engine 150. In various embodiments, the engine 150 comprises an internal combustion engine, such as a gasoline or diesel fueled combustion engine.

In various embodiments, the engine 150 includes a combustion chamber 152 and an intake valve 154, along with the above-referenced port fuel injector 156 and direct fuel injector 158. In various embodiments, the direct fuel injector 158 is directly coupled to the combustion chamber 152, and provides fuel directly to the combustion chamber 152. Also in various embodiments, the port fuel injector 156 is directly coupled to the intake valve 154, and supplies fuel indirectly to the combustion chamber 152 via the intake valve 154, for example when the intake valve 154 is open.

In various embodiments, the control system 102 provides instructions for controlling the drive system 104, including for controlling the engine 150. In various embodiments, the control system 102 comprises an engine control unit (ECU) for the engine 150. Also in various embodiments, among other functionality, the control system 102 selectively controls operation of the port fuel injector 156 and the direct fuel injector 158, including respective ratios of fuel provided therefrom to the combustion chamber 152, in order to control an idle mode for the engine 150 using parameters that include a speed of the vehicle 100 and a measure of roughness of the engine 150. In various embodiments, the control system 102 provides these functions in accordance with the steps of the process 200 described further below in connection with the FIG. 2.

As depicted in FIG. 1, in various embodiments, the control system 102 includes a sensor array 120 and a controller 130.

In various embodiments, the sensor array 120 includes sensors for measuring sensor data. As depicted in FIG. 1, in various embodiments, the sensor array 120 includes one or more engine sensors 122. In various embodiments, the engine sensors 122 comprise one or more engine speed sensors that are configured to obtain data as to a speed of the engine 150 (e.g., revolutions per minute) and/or changes thereof, and/or data used for determining engine speed and/or variations thereof.

Also in various embodiments, the sensor array 120 further includes one or more vehicle speed sensors 124. In various embodiments, the vehicle speed sensors 124 obtain sensor data as to a speed of the vehicle 100 and/or data used for determining the vehicle speed. In certain embodiments, the vehicle speed sensors 124 may comprise one or more wheel speed sensors; however, this may vary in other embodiments.

In addition, in certain embodiments, the sensor array 120 may also include one or more other sensors. For example, in certain embodiments, the sensor array 120 may also include one or more other sensors for detecting when the engine 150 is turned on and/or running, and/or one or more accelerometers used for determining vehicle speed, data and so on.

In various embodiments, the controller 130 is coupled to the sensor array 120, and provides instructions for controlling the engine 150 (including controlling an idle mode for the engine 150) based on the sensor data (including as to a speed of the vehicle 100 and a measure of roughness for the engine 150). As depicted in FIG. 1, in various embodiments, the controller 130 comprises a computer system comprising a processor 132, a memory 134, an interface, a storage device 138, a bus 140, and a disk 146.

As depicted in FIG. 1, the controller 130 comprises a computer system. In certain embodiments, the controller 130 may also include the sensor array 120 and/or one or more other vehicle components. In addition, it will be appreciated that the controller 130 may otherwise differ from the embodiment depicted in FIG. 1. For example, the controller 130 may be coupled to or may otherwise utilize one or more remote computer systems and/or other control systems, for example as part of one or more of the above-identified vehicle devices and systems.

In the depicted embodiment, the computer system of the controller 130 includes a processor 132, a memory 134, an interface 136, a storage device 138, and a bus 140. The processor 132 performs the computation and control functions of the controller 130, and may comprise any type of processor or multiple processors, single integrated circuits such as a microprocessor, or any suitable number of integrated circuit devices and/or circuit boards working in cooperation to accomplish the functions of a processing unit. During operation, the processor 132 executes one or more programs 142 contained within the memory 134 and, as such, controls the general operation of the controller 130 and the computer system of the controller 130, generally in executing the processes described herein, such as the process 200 discussed further below in connection with FIG. 2.

The memory 134 can be any type of suitable memory. For example, the memory 134 may include various types of dynamic random access memory (DRAM) such as SDRAM, the various types of static RAM (SRAM), and the various types of non-volatile memory (PROM, EPROM, and flash). In certain examples, the memory 134 is located on and/or co-located on the same computer chip as the processor 132. In the depicted embodiment, the memory 134 stores the above-referenced program 142 along with one or more stored values 144 (e.g., including, in various embodiments, predetermined threshold values, such as for vehicle 100 speed and engine 150 roughness, for controlling the idle mode for the engine 150).

The bus 140 serves to transmit programs, data, status and other information or signals between the various components of the computer system of the controller 130. The interface 136 allows communications to the computer system of the controller 130, for example from a system driver and/or another computer system, and can be implemented using any suitable method and apparatus. In one embodiment, the interface 136 obtains the various data from the sensor array 120, the drive system 104, the drive system 104, and/or one or more other components and/or systems of the vehicle 100. The interface 136 can include one or more network interfaces to communicate with other systems or components. The interface 136 may also include one or more network interfaces to communicate with technicians, and/or one or more storage interfaces to connect to storage apparatuses, such as the storage device 138.

The storage device 138 can be any suitable type of storage apparatus, including various different types of direct access storage and/or other memory devices. In one exemplary embodiment, the storage device 138 comprises a program product from which memory 134 can receive a program 142 that executes one or more embodiments of one or more processes of the present disclosure, such as the steps of the process 200 discussed further below in connection with FIG. 2. In another exemplary embodiment, the program product may be directly stored in and/or otherwise accessed by the memory 134 and/or one or more other disks 146 and/or other memory devices.

The bus 140 can be any suitable physical or logical means of connecting computer systems and components. This includes, but is not limited to, direct hard-wired connections, fiber optics, infrared and wireless bus technologies. During operation, the program 142 is stored in the memory 134 and executed by the processor 132.

It will be appreciated that while this exemplary embodiment is described in the context of a fully functioning computer system, those skilled in the art will recognize that the mechanisms of the present disclosure are capable of being distributed as a program product with one or more types of non-transitory computer-readable signal bearing media used to store the program and the instructions thereof and carry out the distribution thereof, such as a non-transitory computer readable medium bearing the program and containing computer instructions stored therein for causing a computer processor (such as the processor 132) to perform and execute the program. Such a program product may take a variety of forms, and the present disclosure applies equally regardless of the particular type of computer-readable signal bearing media used to carry out the distribution. Examples of signal bearing media include: recordable media such as floppy disks, hard drives, memory cards and optical disks, and transmission media such as digital and analog communication links. It will be appreciated that cloud-based storage and/or other techniques may also be utilized in certain embodiments. It will similarly be appreciated that the computer system of the controller 130 may also otherwise differ from the embodiment depicted in FIG. 1, for example in that the computer system of the controller 130 may be coupled to or may otherwise utilize one or more remote computer systems and/or other control systems.

Figure 2:
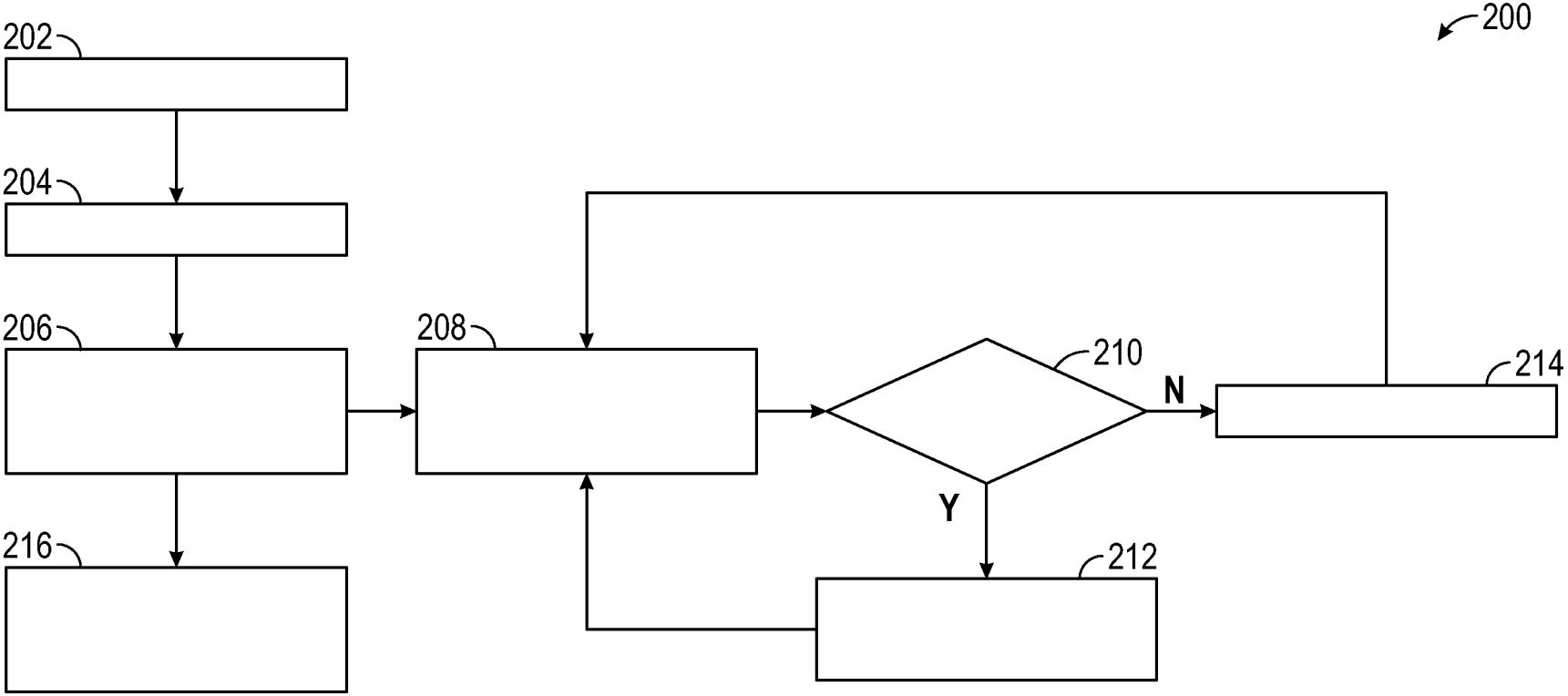
FIG. 2 is a flowchart of a process for controlling the engine, including an idle mode for the engine, using control of the port fuel injector and the direct fuel injector based on vehicle speed and engine roughness, and that can be implemented in connection with the vehicle of FIG. 1, including the control system and the drive system thereof, in accordance with an exemplary embodiment.

FIG. 2 is a flowchart of a process 200 for controlling an idle mode of operation for an engine of a vehicle using a port fuel injector and a direct fuel injector for the engine, in accordance with an exemplary embodiment. In various embodiments, the process 200 may be implemented in connection with the vehicle 100 of FIG. 1, including the drive system 104, the engine 150, and the control system 102 thereof.

As depicted in FIG. 2, in various embodiments the process 200 begins at step 202. In one embodiment, the process 200 begins when a vehicle drive or ignition cycle begins, for example when a driver or other user approaches or enters the vehicle 100, when the driver or other user turns on the vehicle and/or an ignition therefor (e.g. by turning a key, engaging a keyfob or start button, and so on), or when the vehicle begins operation. In one embodiment, the steps of the process 200 are performed continuously during operation of the vehicle.

In various embodiments, sensor data is obtained (step 204). In various embodiments, sensor data is obtained with respect to the operation of the vehicle 100, including the engine 150 thereof, of FIG. 1. In various embodiments, the sensor data is obtained via sensors of the sensor array 120 of FIG. 1 and are provided to the processor 132 142 of FIG. 1 for processing. Also in various embodiments, the sensor data is obtained in step 204 continuously throughout the duration of the process 200.

Specifically, in various embodiments, the sensor data of step 204 includes sensor data as to a speed of the vehicle 100 of FIG. 1 and to a measure of engine roughness of the engine 150 thereof. In certain embodiments, the sensor data of step 204 includes sensor as to the speed of the vehicle and as to changes in speed of the engine 150. Also in certain embodiments, the vehicle speed is measured via the vehicle speed sensors 124 of FIG. 1 and/or is calculated from sensor data therefrom (e.g., from wheel speeds as measured via one or more wheel speed sensors). In addition, in various embodiments, the changes in engine speed are measured via the engine sensors 122 of FIG. 1 and/or are calculated from sensor data therefrom (e.g., from sensors measuring the revolutions per minute of the engine 150, and so on). In certain embodiments, other sensor data may also be obtained, for example as to the user's turning off or on of the vehicle ignition, and so on.

In various embodiments, the sensor data is analyzed and monitored with respect to vehicle velocity, and the fuel injection ratio is adjusted when the vehicle speed is less than a calibrated speed threshold (step 206). In various embodiments, the sensor data is monitored with respect to the vehicle velocity continuously throughout the duration of the process 200. In certain embodiments, the calibrated speed threshold is stored in the memory 134 of FIG. 1 as a stored value 144 thereof. In one exemplary embodiment, the calibrated speed threshold of step 206 is equal to approximately five miles per hour (5 mph) or ten miles per hour (10 mph); however, this may vary in other embodiments. Also it will be appreciated that while step 206 is illustrated in FIG. 2 as a single step, it will be appreciated that in certain embodiments this may comprise two or more steps (e.g., the determination as to whether the velocity exceeds the calibrated speed threshold and the adjustment of the fuel injection ratio).

As used throughout this Application, the term "fuel injection ratio" (also referred to herein as "PDI Ratio" comprises a ratio of (a) fuel provided by the port fuel injector 156 to the combustion chamber 152 to (b) the total fuel provided by the port fuel injector 156 and the direct fuel injector 158 combined to the combustion chamber 152, in accordance with the following equation:

$$\text{PDI Ratio}=(\text{PFI}_{_Fuel})/(\text{PFI}_{_Fuel}+\text{DI}_{_Fuel}) \quad \text{(Equation 1)}$$

in which $\text{PFI}_{Fuel}$ represents the amount of fuel provided by the port fuel injector 156 to the combustion chamber and $\text{DI}_{_Fuel}$ represents the amount of fuel provided by the direct fuel injector 158 to the combustion chamber 152.

Also in certain embodiments, during step 206, when the speed of the vehicle 100 is greater than the calibrated speed threshold of step 206, the fuel injection ratio (or "PDI Ratio") is increased to an increased value as compared to standard or normal operating prior to the performance of step 206. In certain embodiments, during step 206, the PDI ratio is set equal to a maximum PDI ratio allowed for the vehicle 100 (e.g., in accordance with vehicle specifications and/or other requirements, such as from the manufacturer of the vehicle 100 and/or in accordance with any applicable laws, rules, or regulations). In certain embodiments, the maximum PDI ratio is equal to one hundred percent (100%) (signifying that fuel is provided exclusively via the port fuel injector 156); however, this may vary in other embodiments. Also in various embodiments, the PDI Ratio is adjusted via instructions provided by the processor 132 of FIG. 1 to the drive system 104 of FIG. 1.

In various embodiments, engine roughness is monitored (step 208). In various embodiments, the engine roughness is monitored by the processor 132 of FIG. 1 by analyzing the sensor data of step 204. Specifically, in various embodiments, the engine roughness is monitored by monitoring changes in engine speed (e.g., changes in engine revolutions per minute) of the engine 150 of FIG. 1 based on the sensor data obtained via the engine sensors 122 of FIG. 1. As used throughout this Application, "engine roughness" refers to abrupt changes in engine speed that may be categorized as an engine speed disturbance, such as when the engine speed increases by more than a predetermined amount over a specific interval of time (e.g., over a period of one or few seconds time, in certain embodiments).

In various embodiments, a determination is made as to whether the engine roughness has exceeded a predetermined threshold (step 210). In various embodiments, this determination is made as to whether a change in speed of the engine 150 (e.g., a change in revolutions per minute over a specific interval of time) is greater than a predetermined threshold. In various embodiments, the predetermined threshold of step 210 is stored in the memory 134 of FIG. 1 as a stored value 144 thereof. In one exemplary embodiment the predetermined threshold of step 210 is equal to zero (0); however, this may vary n other embodiments. In addition, in certain embodiments, the predetermined threshold of step 210 may also be dependent, in whole or in part, on or more user (e.g., driver) preferences, for example as to fuel economy, and/or the vibration feel in the driver seat that may be effected by the engine operation and roughness, and/or one or more other different types of parameters, and so on.

In various embodiments, when it is determined that the engine roughness exceeds a predetermined threshold (e.g., when it is determined that a change in engine speed over a specific interval of time exceeds the predetermined threshold of step 210), then the PDI ratio is reduced (step 212). Specifically, in various embodiments, during step 212 the PDI ratio is reduced as a function of engine roughness, such that ratio of port fuel injection (PFI) to direct fuel injection (DI) injection decreases as the engine roughness increases. In various embodiments, this is accomplished by (a) decreasing the fuel provided by the port fuel injector; (b) increasing the fuel provided by the direct fuel injector, or both. Also in various embodiments, this is accomplished in accordance with instructions provided by the processor 132 of FIG. 1 to the drive system 104 of FIG. 1. In various embodiments, the process then returns to step 208 in a new iteration, as the engine roughness continues to be monitored.

Conversely, in various embodiments, when it is instead determined that the engine roughness is less than or equal to a predetermined threshold (e.g., when it is determined that a change in engine speed over a specific interval of time is less than or equal to the predetermined threshold of step 210), then the PDI ratio is increased (step 214). Specifically, in various embodiments, during step 214 the PDI ratio is increased, such that ratio of port fuel injection (PFI) to direct fuel injection (DI) injection increases. In various embodiments, this is accomplished by (a) increasing the fuel provided by the port fuel injector; (b) decreasing the fuel provided by the direct fuel injector, or both. Also in various embodiments, this is accomplished in accordance with instructions provided by the processor 132 of FIG. 1 to the drive system 104 of FIG. 1. In various embodiments, the process then returns to step 208 in a new iteration, as the engine roughness continues to be monitored.

As noted above, in various embodiments, the sensor data is monitored with respect to vehicle speed continuously during various iterations of step 206. In various embodiments, if at any time the vehicle speed is below the predetermined threshold of step 206, the process 200 then terminates (step 216). Specifically, in various embodiments, during step 216, the PDI ratio is reduced from its increased value back to its initial value (i.e., its typical or normal operating value prior to the performance of step 206), and the process 200 terminates via an exit function (e.g., stored in the memory 134 of FIG. 1) in accordance with instructions provided by the processor 132 of FIG. 1.

In various embodiments, the process 200 thus allows for engine noise and roughness to both be controlled during an idle mode of operation for the engine 150. Specifically, in various embodiments, as the vehicle 100 maintains relatively low speeds, the PDI ratio is increased (at least initially), thereby managing and potentially reducing engine noise.

Also in various embodiments, as part of the process 200, the engine roughness is also monitored at the same time, during the idle mode of operation for the engine 150. In various embodiments, the PDI ratio is reduced as a function of engine roughness (e.g., as measured in changes of engine speed over a predefined interval of time) when the engine roughness exceeds a predetermined threshold. Conversely, also in various embodiments, the PDI ratio is increased when the engine roughness does not exceed the predetermined threshold. As noted above, in certain embodiments, the threshold utilized for engine roughness may also be dependent on user preferences, such as to fuel economy and seat vibration resulting from engine operation and roughness, among other possible user preferences. In addition, in various embodiments, as described above, the increase in PDI ratio terminates once the vehicle speed exceeds a predetermined speed threshold.

Accordingly, methods and systems, are provided for controlling an idle mode of operation for an engine of a vehicle that includes both a port fuel injector and a direct fuel injector. As described above, in various embodiments, the methods and systems provide control and potential reduction of engine noise while the engine is operating in an idle mode with the vehicle speed below a predetermined threshold, while also monitoring and potentially reducing engine roughness that may otherwise result from the mitigation of the engine noise via the PDI ratio changes. Also in certain embodiments, as noted above, the methods and systems may also be adjusted in order to accommodate user preferences, for example as to fuel economy as well as other factors such as the vibration feel in the driver seat that may be effected by the engine operation and roughness, and so on.

It will be appreciated that the systems, vehicles, applications, and implementations may vary from those depicted in the Figures and described herein. For example, in various embodiments, the vehicle 100, control system 102, drive system 104, engine 150, components thereof, and/or other components may differ from those depicted in FIG. 1 and/or described above in connection therewith. It will also be appreciated that the steps of the process 200 may differ, and/or that various steps thereof may be performed simultaneously and/or in a different order, than those depicted in FIG. 2 and/or described above.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method for controlling operation of an engine of a vehicle during an idle mode of operation for the engine, the engine having a plurality of different types of fuel injectors and a combustion chamber, the plurality of different types of fuel injectors comprising a port fuel injector and a direct fuel injector, the method comprising:

obtaining, via one or more first sensors of the vehicle, first sensor data as to a speed of the vehicle;

obtaining, via one or more second sensors of the vehicle, second sensor data as to a measure of roughness of the engine; and adjusting, via instructions provided by a processor of the vehicle, a fuel injection ratio of respective amounts of fuel provided by the plurality of different types of fuel injectors to the combustion chamber, based on both the speed of the vehicle and the measure of roughness of the engine, wherein the adjusting of the fuel injection ratio comprises adjusting the fuel injection ratio of the respective amounts of fuel provided by the port fuel injector and the direct fuel injector, respectively, based on both the speed of the vehicle and the measure of roughness of the engine, including by increasing a ratio of (a) fuel provided by the port fuel injector to the combustion chamber to (b) a total fuel provided by the port fuel injector and the direct fuel injector combined to the combustion chamber (the "PDI Ratio") from an initial value to an increased value, when the speed of the vehicle is less than a non-zero predetermined threshold, wherein the non-zero predetermined threshold is greater than or equal to approximately five miles per hour (mph).

2. The method of claim 1, wherein the adjusting of the fuel injection ratio further comprises:

reducing the PDI ratio from its increased value to its initial value, when the speed of the vehicle is no longer less than the non-zero predetermined threshold.

3. The method of claim 1, wherein the increasing of the PDI Ratio comprises increasing the PDI ratio to a maximum PDI ratio, subject to the measure of roughness of the engine.

4. The method of claim 1, wherein the adjusting of the fuel injection ratio further comprises:

reducing the PDI ratio, when the measure of roughness of the engine exceeds a second predetermined threshold.

5. The method of claim 4, wherein the adjusting of the fuel injection ratio further comprises:

increasing the PDI ratio, when the measure of roughness of the engine is less than or equal to the second predetermined threshold.

6. The method of claim 4, wherein the reducing of the PDI ratio comprises reducing the PDI ratio as a function of engine roughness over a predetermined interval of time when the measure of roughness of the engine exceeds the second predetermined threshold.

7. The method of claim 4, wherein the reducing of the PDI ratio comprises reducing the PDI ratio as a function of measured changes in engine speed over a predefined interval of time when the measure of roughness of the engine exceeds the second predetermined threshold.

8. The method of claim 4, wherein the second predetermined threshold is calibratable by a user based on one or more preferences of the user, including as to fuel economy preferences, vibration tolerances, or both.

9. The method of claim 1, wherein:

the obtaining the second sensor data comprises obtaining engine data as to a change in engine speed of the engine over time; and the adjusting of the fuel injection ratio comprises adjusting the PDI ratio, via the instructions provided by the processor, by:

reducing the PDI ratio, when the change in engine speed over time exceeds a second predetermined threshold; and increasing the PDI ratio, when the change in engine speed over time does not exceed the second predetermined threshold.

10. The method of claim 1, wherein the non-zero predetermined threshold for the speed of the vehicle is equal to approximately five miles per hour (5 mph).

11. The method of claim 1, wherein the non-zero predetermined threshold for the speed of the vehicle is equal to approximately ten miles per hour (10 mph).

12. A system for controlling operation of an engine of a vehicle during an idle mode of operation for the engine, the engine having a plurality of different types of fuel injectors and a combustion chamber, the plurality of different types of fuel injectors comprising a port fuel injector and a direct fuel injector, the system comprising:

one or more first sensors of the vehicle that are configured to obtain first sensor data as to a speed of the vehicle;

one or more second sensors of the vehicle that are configured to obtain second sensor data as to a measure of roughness of the engine; and a processor that is coupled to both the one or more first sensors and the one or more second sensors and that is configured to at least facilitate adjusting a fuel injection ratio of respective amounts of fuel provided by the plurality of different types of fuel injectors to the combustion chamber, based on both the speed of the vehicle and the measure of roughness of the engine, via instructions provided by the processor, wherein the processor is configured to adjust the fuel injection ratio by adjusting the fuel injection ratio of the respective amounts of fuel provided by the port fuel injector and the direct fuel injector, respectively, based on both the speed of the vehicle and the measure of roughness of the engine, including by increasing a ratio of (a) fuel provided by the port fuel injector to the combustion chamber to (b) a total fuel provided by the port fuel injector and the direct fuel injector combined to the combustion chamber (the "PDI Ratio") from an initial value to an increased value, when the speed of the vehicle is less than a non-zero predetermined threshold, wherein the non-zero predetermined threshold is greater than or equal to approximately five miles per hour (mph).

13. The system of claim 12, wherein the processor is configured to at least facilitate:

increasing the PDI ratio to a maximum PDI ratio, subject to the measure of roughness of the engine; and adjusting the fuel injection ratio by reducing the PDI ratio from its increased value to its initial value, when the speed of the vehicle is no longer less than the non-zero predetermined threshold.

14. The system of claim 12, wherein the processor is configured to at least facilitate:

reducing the PDI ratio, when the measure of roughness of the engine exceeds a second predetermined threshold; and increasing the PDI ratio, when the measure of roughness of the engine is less than or equal to the second predetermined threshold.

15. The system of claim 12, wherein:

the one or more first sensors and configured to obtain obtaining engine data as to a change in engine speed of the engine over time; and the processor is configured to at least facilitate adjusting the PDI ratio, via the instructions provided by the processor, by:

reducing the PDI ratio, when the change in engine speed over time exceeds a second predetermined threshold; and increasing the PDI ratio, when the change in engine speed over time does not exceed the second predetermined threshold.

16. A vehicle comprising:

an engine having a plurality of different types of fuel injectors and a combustion chamber, the plurality of different types of fuel injectors comprising a port fuel injector and a direct fuel injector;

one or more first sensors of the vehicle that are configured to obtain first sensor data as to a speed of the vehicle;

one or more second sensors of the vehicle that are configured to obtain second sensor data as to a measure of roughness of the engine; and a processor that is coupled to both the one or more first sensors and the one or more second sensors and that is configured to at least facilitate adjusting a fuel injection ratio of respective amounts of fuel provided by the plurality of different types of fuel injectors to the combustion chamber, based on both the speed of the vehicle and the measure of roughness of the engine, via instructions provided by the processor, wherein the processor is configured to adjust the fuel injection ratio by adjusting the fuel injection ratio of the respective amounts of fuel provided by the port fuel injector and the direct fuel injector, respectively, based on both the speed of the vehicle and the measure of roughness of the engine, including by increasing a ratio of (a) fuel provided by the port fuel injector to the combustion chamber to (b) a total fuel provided by the port fuel injector and the direct fuel injector combined to the combustion chamber (the "PDI Ratio") from an initial value to an increased value, when the speed of the vehicle is less than a non-zero predetermined threshold, wherein the non-zero predetermined threshold is greater than or equal to approximately five miles per hour (mph).

17. The vehicle of claim 16, wherein the processor is configured to at least facilitate adjusting the fuel injection ratio by reducing the PDI ratio from its increased value to its initial value, when the speed of the vehicle is no longer less than the non-zero predetermined threshold.

18. The vehicle of claim 16, wherein the processor is configured to at least facilitate increasing the PDI ratio to a maximum PDI ratio, subject to the measure of roughness of the engine.

19. The vehicle of claim 16, wherein the processor is configured to at least facilitate:

reducing the PDI ratio, when the measure of roughness of the engine exceeds a second predetermined threshold; and increasing the PDI ratio, when the measure of roughness of the engine is less than or equal to the second predetermined threshold.

20. The vehicle of claim 16, wherein:

the one or more first sensors configured to obtain engine data as to a change in engine speed of the engine over time; and the processor is configured to at least facilitate adjusting the PDI ratio, via the instructions provided by the processor, by:

reducing the PDI ratio, when the change in engine speed over time exceeds a second predetermined threshold; and increasing the PDI ratio, when the change in engine speed over time does not exceed the second predetermined threshold.

* * * * *